US007007391B2

(12) United States Patent
Stoick et al.

(10) Patent No.: US 7,007,391 B2
(45) Date of Patent: Mar. 7, 2006

(54) DUAL CONTAINMENT TUBING CUTTER

(75) Inventors: John B. Stoick, Chaska, MN (US); Michael A. Stoick, Prior Lake, MN (US); Carlos Cadavid, Chanhassen, MN (US)

(73) Assignee: Entegris, Inc., Chaska, MN (US)

( * ) Notice: Subject to any disclaimer, the term of this patent is extended or adjusted under 35 U.S.C. 154(b) by 454 days.

(21) Appl. No.: 10/001,708

(22) Filed: Oct. 18, 2001

(65) Prior Publication Data

US 2003/0074794 A1 Apr. 24, 2003

(51) Int. Cl.
*B23D 21/06* (2006.01)
*B21F 13/00* (2006.01)

(52) U.S. Cl. ..... 30/101; 30/102

(58) Field of Classification Search ..... 30/94, 30/93, 92, 95, 99–102, 300, 329, 289; D8/41, D8/14, 20, 95–100; 401/152, 197, 208, 219, 401/220; 82/47, 100; 15/104.04, 104.03, 15/105

See application file for complete search history.

(56) References Cited

U.S. PATENT DOCUMENTS

| | | | | | |
|---|---|---|---|---|---|
| 609,138 | A | * | 8/1898 | Burrell | 30/94 |
| 882,432 | A | | 3/1908 | Thomas | |
| 1,866,095 | A | * | 7/1932 | Foley | 30/90.7 |
| 2,003,630 | A | * | 6/1935 | Errig et al. | 83/439 |
| 2,050,768 | A | * | 8/1936 | Seymour | 30/2 |
| 2,254,199 | A | * | 9/1941 | Baltuch | 30/289 |
| 2,276,268 | A | * | 3/1942 | Donlon | 30/1.5 |
| 2,410,901 | A | | 11/1946 | Ramsey | 49/52 |
| 2,869,413 | A | * | 1/1959 | Anderson | 86/24 |
| 2,961,765 | A | * | 11/1960 | Brooks | 30/102 |
| 3,335,492 | A | * | 8/1967 | Spiro | 30/101 |
| 3,636,629 | A | * | 1/1972 | Baun | 30/94 |
| 3,839,788 | A | * | 10/1974 | Addis | 30/287 |
| 4,092,775 | A | * | 6/1978 | Erpenbeck | 30/95 |
| 4,114,266 | A | * | 9/1978 | Erpenbeck | 30/123 |
| 4,139,941 | A | * | 2/1979 | Meacham | 30/123 |
| 4,146,959 | A | * | 4/1979 | Hopper | 30/95 |
| 4,177,557 | A | | 12/1979 | Courty | |
| 4,305,205 | A | | 12/1981 | Girala | 30/102 |
| 4,312,127 | A | | 1/1982 | Tanaka | 30/92 |
| 4,382,330 | A | * | 5/1983 | Harbaugh | 30/124 |
| 4,441,400 | A | * | 4/1984 | Sexton | 86/49 |
| 4,631,829 | A | * | 12/1986 | Schmidt et al. | 30/294 |

(Continued)

OTHER PUBLICATIONS

International Search Report (PCT/US02/33087) dated Dec. 9, 2002.

*Primary Examiner*—Allan N. Shoap
*Assistant Examiner*—Ghassem Alie
(74) *Attorney, Agent, or Firm*—Patterson, Thuente, Skaar & Christensen, P.A.

(57) ABSTRACT

The present invention is a C-shaped plastic tubing cutter having a C-shaped grasping portion and a fixed cutting blade. The grasping portion has an opening for receiving the tubing whereby the width of the opening is measurably smaller than the diameter of the tubing to permit snap engagement of the tubing into the grasping portion upon sufficient force and retention therein. In addition, the inner diameter of the grasping portion can be measurably smaller than the outer diameter of the tubing to promote securement of the tubing within the grasping portion to better facilitate precision cutting. Once engaged, a grasping bias force brings the inner surface of the grasping portion into substantial circumferential contact with the tubing to again promote securement and cutting. The circumferential contact is greater than 50 percent, and generally less than 75 percent, of the tubing circumference.

13 Claims, 3 Drawing Sheets

U.S. PATENT DOCUMENTS

| | | | | | |
|---|---|---|---|---|---|
| 4,734,982 | A | | 4/1988 | Khoja | 30/96 |
| 4,739,554 | A | | 4/1988 | Hytönen | 30/101 |
| 4,831,732 | A | | 5/1989 | Garton | 30/101 |
| 4,852,255 | A | * | 8/1989 | Hochfeld | 30/102 |
| 4,890,385 | A | * | 1/1990 | VanderPol et al. | 30/101 |
| D308,811 | S | | 6/1990 | Hochfeld | |
| 5,123,320 | A | * | 6/1992 | Hochfeld | 83/856 |
| 5,206,996 | A | | 5/1993 | McDaniel | 30/101 |
| 5,285,576 | A | * | 2/1994 | Taylor | 30/94 |
| 5,325,587 | A | * | 7/1994 | Steiner et al. | 30/91.2 |
| D352,440 | S | * | 11/1994 | Perigny | D8/98 |
| 5,381,601 | A | * | 1/1995 | Danter et al. | 30/90.1 |
| D362,168 | S | * | 9/1995 | Mancini | D8/98 |
| D376,091 | S | * | 12/1996 | Heglin | D8/98 |
| D381,886 | S | * | 8/1997 | Domenico | D8/98 |
| 5,653,023 | A | * | 8/1997 | Andina | 30/1.5 |
| 5,765,288 | A | * | 6/1998 | Hagler, Jr. | 30/280 |
| 5,815,866 | A | * | 10/1998 | Janky | 7/114 |
| 5,836,079 | A | | 11/1998 | Cronin et al. | 30/101 |
| 5,887,346 | A | | 3/1999 | McCasland | |
| 5,956,853 | A | * | 9/1999 | Watamura | 30/95 |
| 6,032,371 | A | * | 3/2000 | Chou | 30/294 |
| 6,065,212 | A | | 5/2000 | Lazarevic | 30/101 |
| 6,154,963 | A | * | 12/2000 | Kooiman | 30/90.2 |
| 6,202,307 | B1 | * | 3/2001 | Wrate | 30/101 |
| D446,103 | S | | 8/2001 | Olañeta | |
| D458,820 | S | * | 6/2002 | Kay | D8/41 |
| 6,434,776 | B1 | * | 8/2002 | Pfeiffer et al. | 15/104.04 |
| 2002/0083593 | A1 | * | 7/2002 | Chang | 30/92 |

* cited by examiner

DUAL CONTAINMENT TUBING CUTTER

FIELD OF THE INVENTION

The present invention relates generally to the field of tubing cutters. More specifically, this invention relates to a C-shaped tubing cutter for use in cutting the outer tubing in a dual containment tubing system such that complete penetration through the outer tubing is avoided.

BACKGROUND OF THE INVENTION

The use of various cutters for cutting piping and tubing is common place. Typically, piping or tubing is manufactured and delivered to end users in predetermined lengths that exceed the lengths required by the end users for specific jobs or tasks. As a result, various cutters are needed to cut the piping or tubing to specifically desirable lengths, either before or after installation.

Dual containment tubing systems generally consist of an outer tubing and an inner tubing. The tubing is made of plastic material and, in the field of semiconductor processing in particular, the tubing is often made of special plastics such as PFA, FEP, Olefin (such as HDPE or PP), or other fluorinated hydrocarbons that have suitable chemical resistance. These resistant resins or plastics are required in the processing of semi-conductor wafers into integrated circuits since highly corrosive, ultra-pure fluids, such as hydrochloric, sulfuric and hydrofluoric acid, are utilized, often in extreme temperature ranges.

In such dual containment tubing systems such as these, it is often necessary to merely cut the outer tubing. However, in doing so, it is essential that the inner tubing, or tubings, not be damaged, or themselves cut. This is a potential problem since it is not uncommon for the inner tubing to shift or rest against, or extremely close to, the inner surface of the outer tubing.

The vast majority of conventional cutters are wrench-like or plier-like devices for engaging piping or tubing for rotational movement around the outer diameter of the tubing. Generally, these devices implement discs or rollers to facilitate the rotational movement, with at least one of the discs having a bladed edge for cutting. The key to such devices is to keep the cutting edges of the discs in biased engaged against the piping or tubing such that necessary blade force is continuously applied for the entire rotational period. This biased engagement is typically achieved by human force upon two generally paralled handle portions, such as those used in other tools like wrenches and pliers, or with other force actuating means. These devices comprise relatively complex springs, pins, racheting means, gears, and other systems and components needed to promote cutting force and the circumferential adjustability of the rollers and disc blades around the piping or tubing of various outer diameters. U.S. Pat. Nos. 4,305,205 and 5,206,996 disclose such devices.

U.S. Pat. Nos. 4,831,732 and 5,285,576 disclose a variation on the disc and roller designs. Each has rollers and disc blades to enable rotational cutting around piping. However, unlike the previously discussed tools, these cutters do not actuate force upon the piping with adjustable wrench-like or plier-like techniques. Instead, these cutters rely primarily on spring-biased engagement. These cutters are generally C-shaped or cylindrical for receiving piping such that the rollers provide a measurable containment of the piping within the cutter at tangential points of contact. The piping does not engage in substantial contact with the rollers or any other surface of the cutters as a result of these limited tangential contacts.

There have been some attempts at creating cutters that utilize a straight cutting blade rather than traditional disc blades. These straight blade cutters are particularly useful in cutting plastic tubing or pipes. The relatively malleable and soft plastic material makes it possible to cut through the tubing with fewer rotational passes over the surface of the tubing. U.S. Pat. Nos. 4,734,982 and 4,739,554 are two examples of such tubing cutters. One embodiment of the '554 patent utilizes a series of ledges opposite the cutting blade such that tangential contacts are made at the blade and on the applicable ledge. These ledges are variably distanced from the blade in an attempt to permit receipt of tubing of various diameters. However, like many conventional cutters, it merely receives the tubing at tangential points of contact, thus lacking the ability to truly grasp onto the tubing to better facilitate precise and even cutting. The '982 patent suffers from similar drawbacks.

While the cutter disclosed in the '982 patent is cylindrical it also fails to adequately grasp or snap onto the plastic tubing. Rather than tightly engaging the tubing, the cutter blade is adjustably moved in and out of the receiving aperture of the tool to engage the tubing so that tubing of various potential diameters can be received by the cutter. However, this attempt at increasing the ability to cut various-sized tubing leaves the cutter incapable of properly grasping the tubing such that precise and even cutting is facilitated. The adjustability of the blade positioning merely results in extended tangential contacts with any tubing that is not substantially identical in diameter to that of the apertures.

None of these conventional techniques and devices disclose a cutter ideal for cutting dual containment tubing systems. Consequently, there is a need for a C-shaped tubing cutter designed to "snap" onto and grasp the tubing such that rotation of the cutter around the outer surface of the tubing causes the cutter's fixed blade to cut the tubing to a depth short of complete penetration through the wall of the tubing. In addition, this C-shaped cutter should circumferentially engage the tubing along a significant portion of the outer circumference of the tubing to facilitate secure and precise cutting action. Further, this desired tubing cutter should be of relatively simplistic design, designed for securement and use within small spaces, and made of a relatively low-friction, contaminant-resistant plastic.

BRIEF SUMMARY OF THE INVENTION

The present invention in particular embodiments has plastic a C-shaped tubing grasping portion and a fixed cutting blade. The grasping portion has an opening for receiving the tubing whereby the width of the opening is measurably smaller than the diameter of the tubing to permit snap engagement of the tubing into the grasping portion upon sufficient force. In addition, the inner diameter of the tubing grasping portion can be measurably smaller than the outer diameter of the tubing to promote securement of the tubing within the grasping portion to better facilitate precision cutting. Once engaged, a grasping bias force brings the inner surface of the grasping portion into substantial circumferential contact with the tubing to again promote securement and cutting. The circumferential contact is greater than 50 percent, and generally less than 75 percent, of the tubing circumference.

An advantage and feature of particular embodiments of the present invention is that the size and dimensions of the opening to the C-shaped portion of the cutter results in snap engagement of the tubing into the cutter, thus eliminating the need for complicated and costly components used in conventional cutters to engage tubing.

Another advantage and feature of particular embodiments of the present invention is that the size and shape of the C-shaped grasping portion promotes increased circumferential contact between the inner surface of the grasping portion and the outer surface of the tubing to increase cutting precision and tubing securement during rotational cutting.

Still another advantage and feature of particular embodiments of the present invention is in its ability to create a score cut line into the tubing without completely penetrating through the tubing wall. This is particularly beneficial when cutting the outer tubing in a dual containment tubing system.

Yet another advantage and feature of particular embodiments of the present invention is that it is capable of receiving a common single-edged razor blade as its fixed blade.

A further advantage and feature of particular embodiments of the present invention is that it is simplistic in design and component parts, thus reducing manufacturing costs, simplifying use, decreasing the potential for malfunction.

A still further advantage and feature of particular embodiments of the present invention is that it can be made almost completely of an inexpensive plastic such as high density polyethelene or metal. In addition, the use of such a plastic cutter with a dual containment tubing system made of similar material will result in a relatively low coefficient of friction between the tubing and the cutter, thus further promoting precision cutting.

Yet another advantage and feature of particular embodiments of the present invention is in its compact and simple design. Its simplistic design means that its size and shape can be reduced to better promote use in confined and cramped spaces.

DETAILED DESCRIPTION OF THE DRAWINGS

Figure 1:
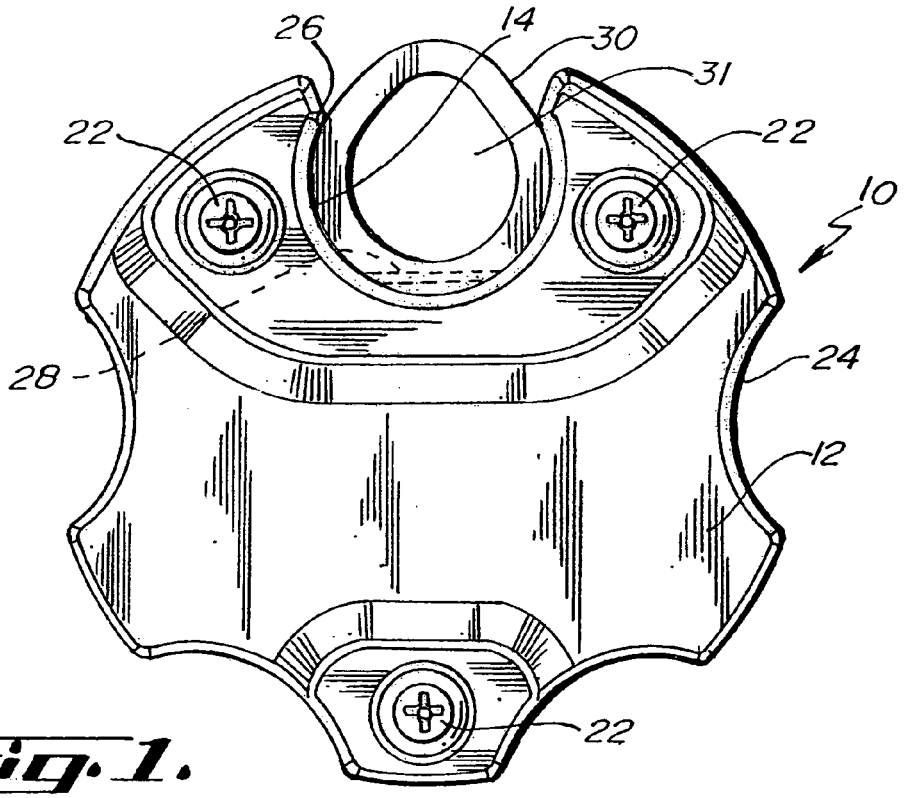
FIG. 1 is a front view of a tubing cutter according to a preferred embodiment of the present invention engaged with plastic tubing.
Figure 2:
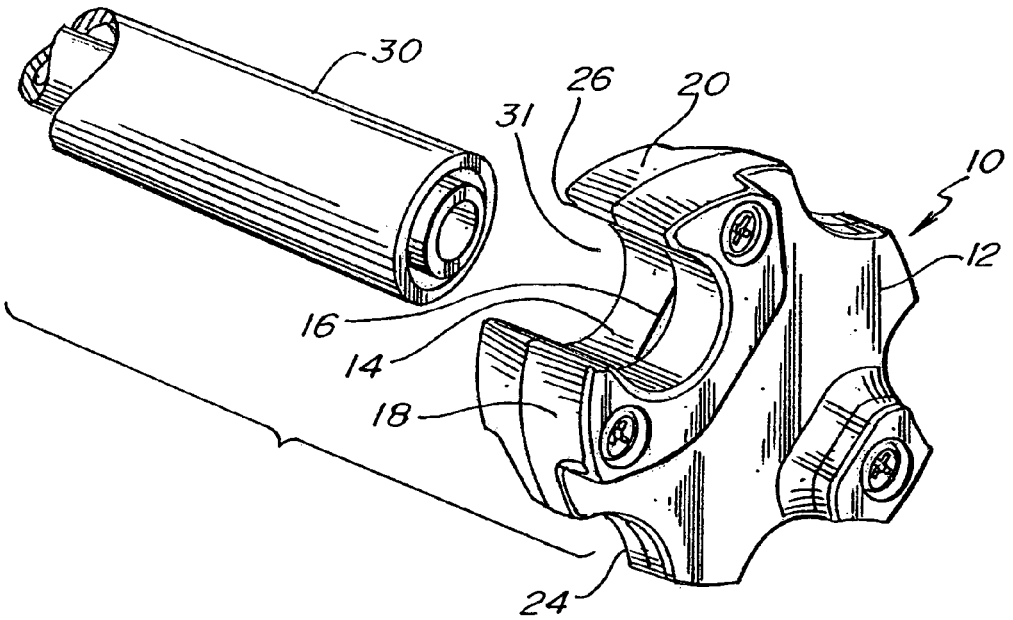
FIG. 2 is a perspective view of a tubing cutter according to a preferred embodiment of the present invention.

Referring to FIGS. 1–6, a preferred embodiment of the C-shaped dual containment tubing cutter 10 according to the present invention is shown and is principally comprised of a cutter body 12, a C-shaped grasping portion 14, and a fixed cutter blade 16.

The body 12 is comprised primarily of a front piece 18, a back piece 20, fastening means 22, and gripping portions 24. The pieces 18, 20 are removably securable together with each piece typically mirroring the other in shape, size, and symmetry. The pieces 18, 20 are joined together with the use of fastening means 22. The fastening means 22 can be screws, bolts, clips, and the like. In a preferred embodiment, the fastening means 22 are three spaced screws that pass through front piece 18, into back piece 20, with the screw not passing completely through the back piece 20. The joining or securement of the pieces 18, 20 together results in a symmetry of the body 12 along the axis defining the width and thickness of the body 12.

The gripping portions 24 are preferably arcuate depressions on each side of the body 12. These gripping portions 24 enable an end user to easily engage the plastic tubing 30, handle the device, and rotate the cutter 10, thus eliminating the need in a preferred embodiment for a handle or other extended mechanisms or apparatus. A gripping portion built into the body 12 of the cutter 10 makes it possible to use the cutter in confined or small spaces. Preferably, an end user's index finger rests in one of the gripping depressions, with the thumb resting in the other. In addition, other arcuate depressions can be added to the end of the body 12 opposite the end containing the C-shaped grasping portion 14. In addition, alternative embodiments can introduce various depression shapes, texturing on the body to enhance gripping friction, and even a handle mechanism to facilitate engagement, handling and rotation. Clockwise and counterclockwise rotation of the cutter 10 around the tubing 30 is envisioned.

The C-shaped grasping portion 14 opens into a tubing engagement opening 26. The grasping portion 14 is sized to grasp the tubing 30 of a predetermined diameter. Cutters can come in various pre-selected sizes such that an individual cutter is sized to engage and grasp tubing having a specific diameter. The width of the opening 26 is a distance less than the diameter of the applicable tubing 30 being introduced into the grasping portion 14. This dimension difference creates a need for the end user to apply a measurable level of force when introducing the tubing 30 into the grasping portion 14, through the opening 26. Once the threshold level of force is applied, the tubing 30 will "snap" into a tubing receiving region 31 defined by the grasping portion 14 and be restrained therein. A level of deformation occurs with regard to the tubing 30. Upon engagement of the tubing 30 through the opening 26, at least a portion of the normally cylindrical tubing 30 is temporarily re-shaped into an oval configuration which is best demonstrated in FIG. 4. This re-shaping is a direct result of the dimension difference between the opening 26 and the tubing 30 diameter.

Once a portion of the tubing 30 has entered into the grasping portion 14 through forceful engagement, it will eventually reach a resting position within the grasping portion 14. In the force-initiated resting position defining complete engagement, the tubing 30 is partially penetrated by the fixed blade 16. At complete engagement, as shown best in FIG. 4, the circumference of the engaged portion of the tubing 30 is in contact with substantially the entire inner surface of the grasping portion 14. The inner diameter of the grasping portion 14 can be slightly smaller than the outer diameter of the tubing 30. This, in addition to further facilitating the above-mentioned shape deformation, enhances the grasping function of the cutter 10.

Preferably, the concave C-shape of the grasping portion 14 substantially contacts greater than 50 percent of the circumference of the tubing 30. A percentage greater than 50 ensures that the grasping function of the grasping portion 14 will serve to retain the tubing within the grasping portion 14. Of course, there is a wide range of circumferential contact that will facilitate this grasping function. However, at some point the percentage of contact will become too great and narrow the width of the opening 26 to a point where engagement of the tubing 30 is too difficult, or even impossible. A preferred percentage believed to be somewhere between 50 and 75 percent.

Angular orientation is another useful method of describing and understanding the grasping function of the grasping portion 14. Grasping of 50 percent of the circumference of the tubing 30 could be further described as grasping the tubing 30 such that the beginning and end contact points on the outer circumference of the tubing 30 are 180 degrees from one another. Thus, a percentage greater than 50 percent would increase proportionately the angular orientation. Preferably, angular ranges between 181 and 270 degrees could be implemented. The closer to 270 degrees one gets, the more difficult it will be to engage the tubing 30. Engagement, of course, will depend greatly on the force exerted, the flexibility of the tubing, and the snap engagement level sought.

Of course, the level of engagement will greatly influence the level of circumferential contact between the inner surface of the grasping portion 14 and the circumference of the tubing 30. Namely, engagement less than complete engagement may not initiate penetration of the blade 16 into the tubing, or may penetrate a relatively negligible depth. Consequently, when complete engagement is not achieved, the grasping function of the grasping portion 14 will vary. While mere snap engagement of the tubing 30 through the opening 26 will inevitably result in substantial circumferential contact, there may be gaps of surface contact. In addition, the inner surface of the grasping portion 14 can be designed or manufactured such that there are gaps, grooves, and general surface designs that form a concave of varying configurations. These would also result in varying levels of circumferential surface contact with the tubing 30.

The fixed cutter blade 16 generally has an exposed portion 28 that is positioned within the concave of the grasping portion 14, as shown in FIG. 1. In a preferred embodiment, this exposed portion 28 is horizontally centered at the bottom of the concave grasping portion 14. However, in alternative embodiments a fixed blade 16, and/or an exposed portion 28 of a fixed blade 16, could be positioned in other locations along the interior of the grasping portion 14.

Figure 4:
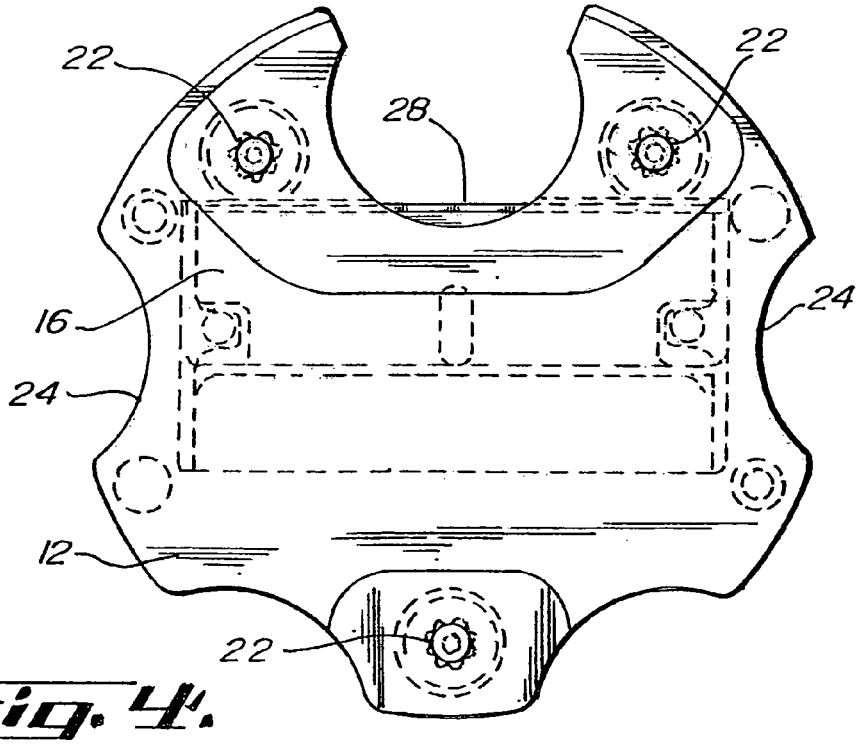
FIG. 4 is a back view of a tubing cutter according to a preferred embodiment of the present invention illustrating positioning of a cutter blade.
Figure 5:
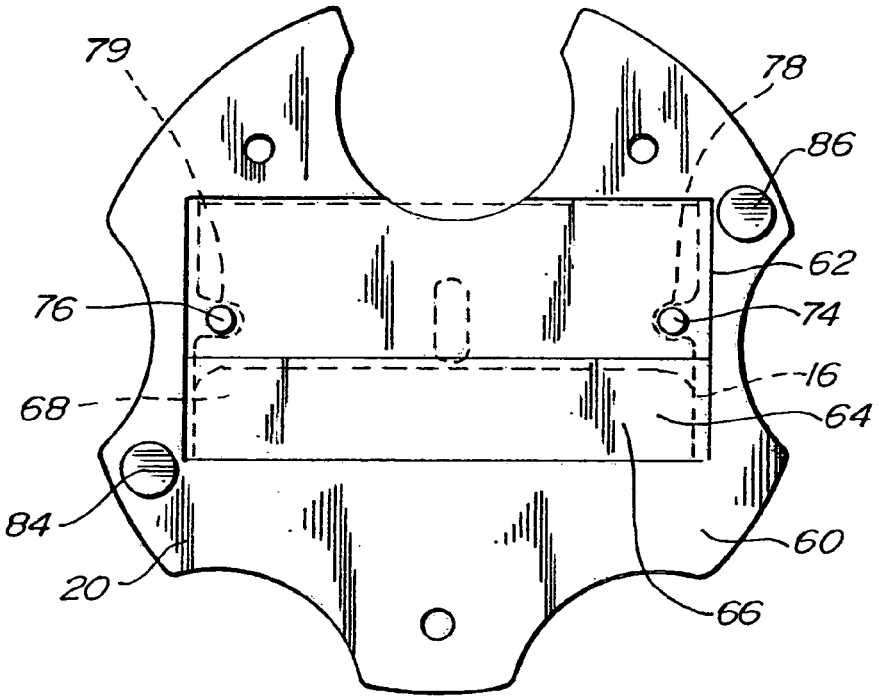
FIG. 5 is a view of the inside face of the one of the body pieces of a C-shaped tubing cutter according to a preferred embodiment of the present invention.

Preferably, the fixed cutter blade 16 is a common single-edged razor. FIGS. 4 and 5 shows the location and securement of the blade 16 within the body 12. However, other specialized fixed straight blades can be used in alternative embodiments. The razor 16 is positioned in between the pieces 18, 20 such that joining of the pieces to form the body 12 secures the blade 16. Insertion and positioning of the blade 16 at its resting position between the pieces 18, 20 can be accomplished using recesses, grooves, notches, pins, adhesive, and the like. Generally, the fixed position is predetermined whereby the exposed portion 28 is exposed a distance into the grasping portion 14 so that complete engagement is possible without forcing penetration of the blade through the entire wall of the tubing 30. The positioning could also be variably adjustable. For instance, and in a preferred embodiment, insertion and positioning adjustments of the blade 16 are possible through the adjustment and/or removal of fastening means 22.

Figure 6:
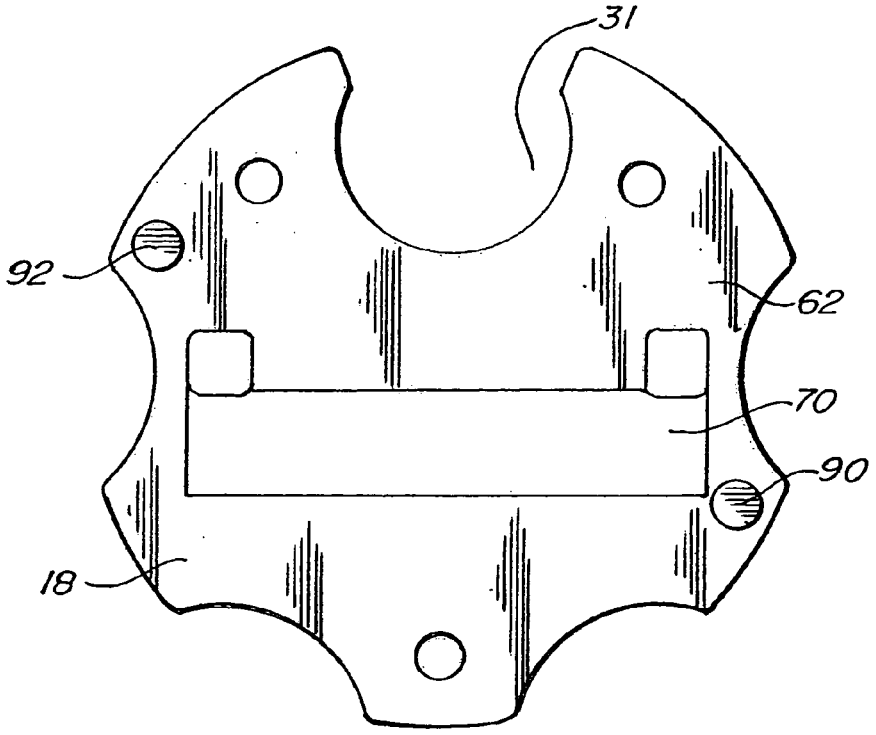
FIG. 6 is a view of the inside face of the other of the body pieces of a C-shaped tubing cutter according to a preferred embodiment of the present invention.

Referring to FIGS. 5 and 6 the inside faces 60, 62 of the front piece 18 and back piece 20, respectively, of the body 12. The back piece face 60 has a recess 62 sized to the blade 16 shown in detail lines. Recesses 84, 86 on the inside face of the back piece 20 engage with cooperative protrusions 90, 92 on the front piece 18 to align and fix the two pieces.

A slightly deeper recess 64 on the back piece face provides a receiving area 66 sized to the razor blade flange 68. A corresponded recess 70 on the front piece face also receives the flange and facilitates sandwiching the blade between the two pieces of the body and maintaining face-to-face contact of the pieces. Nubs 74, 76 on the back piece face fit into the side recesses 78, 79 of the razor blade and confront or seat against cooperating recess 80, 81 on the front piece face.

Figure 3:
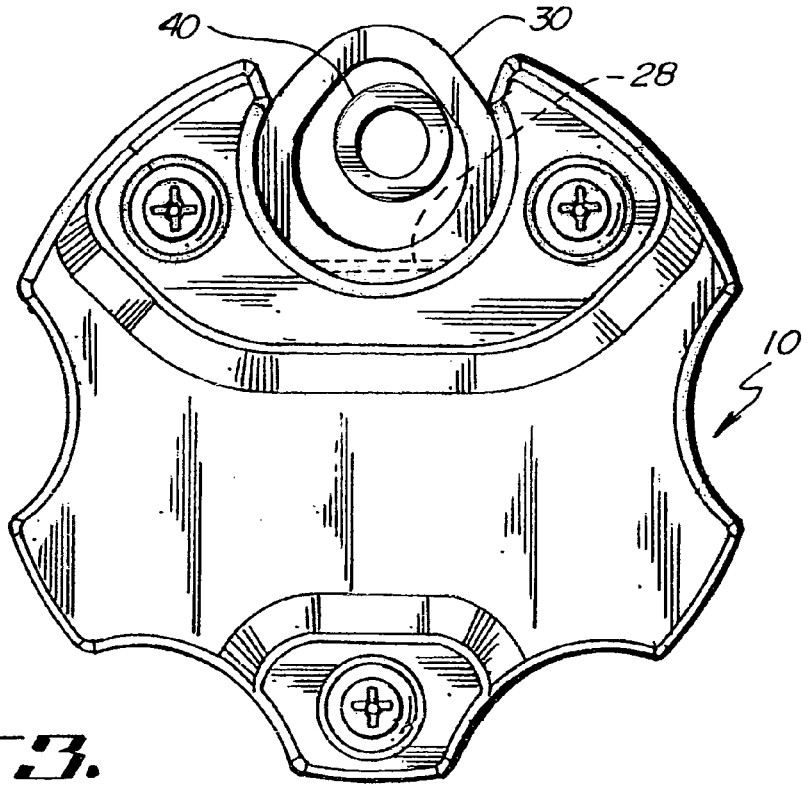
FIG. 3 is a front view of a tubing cutter according to a preferred embodiment of the present invention.

In operation, plastic tubing 30 is aligned with the opening 26 of the grasping portion 14 in preparation for engagement, as shown in FIG. 3. Gripping the body 12 of the cutter 10 at the gripping portions 24, snap engagement is initiated when a measurable percentage of the tubing 30 is forced past the opening 26 and into the grasping portion 14. Forced engagement is ideally sufficient when the tubing 30 is in complete engagement with the grasping portion 14. This complete engagement is when the exposed portion 28 of the blade 16 is partially penetrating the tubing 30, with complete penetration through the tubing wall avoided.

Upon complete engagement, the cutter 10 is rotated clockwise or counterclockwise around the circumference of the tubing 30. Ideally, a single rotation is all that is needed. However, as the blade becomes dull, more cutting rotations may be required. Excessive rotations will not generally effect the depth of the cut into the tubing 30 since that is a function of the cutting edge of the blade 16. In addition, and unlike conventional methods, cutting force is substantially continuous without the adjustment of gears, springs or clamping mechanisms. The tubing 30 securely rests within the grasping portion 14 and additional force is not needed to keep the cutter 10 engaged during rotational cutting. This generally continuous engagement force enhances ease of use and precision cutting along the surface of the tubing 30. In addition, the substantial circumferential surface contact prevents gaps in cutting along the surface of the tubing.

In a preferred embodiment, the rotational cutting motion creates a score line into the tubing 30 that does not completely penetrate the wall of the tubing 30. This is especially useful when cutting the outer tubing 30 of a dual containment tubing system. Complete penetration is avoided, thus protecting a second inner tubing 40 which may be resting against the inner diameter of the outer tubing 30 that is being scored, as shown in FIG. 6. It should be noted that alternative embodiments could be designed with a blade 16 that is designed to completely penetrate the tubing 30. However, this is not preferred, especially for use in the field of dual containment tubing systems.

After rotational cutting is complete, the tubing 30 is forcibly removed from its engagement position in the grasping portion 14. With the end user gripping either side of the score line, a breaking force will break the tubing 30 along the score line. Of course, the deeper the cutting penetration is, the less force that is needed to actuate the break along the score line. This cutting process can be repeated along other tubing segements, or multiple portions of the same tubing. When the blade 16 becomes unacceptably dull, the fastening means 22 can be loosed or removed to release the blade 16 from its resting position between the pieces 18, 20, and a new blade 16 can be inserted.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A tubing cutter to snap onto and circumferentially grasp plastic tubing to facilitate the rotational cutting of the tubing, the cutter comprising:

a cutter body having a front piece removably securable to a back piece such that securement of the front piece and back piece form the body, the body further having symmetrical side portions having alignably opposed arcuate gripping depressions;

a C-shaped grasping portion formed in the body, the grasping portion including an opening, a tube receiving portion, and a bottom portion directly opposite the opening, the opening having a width generally less than the width of the tube receiving portion and the tube receiving portion having a width generally less than the diameter of the plastic tubing such that the C-shaped grasping portion receives the plastic tubing with snap engagement, deforming the plastic tubing within the grasping portion and securely retaining the plastic tubing during the cutting of the tubing; and a fixed razor blade secured between the front and back pieces of the body such that a chordal portion of the blade extends into the grasping portion across the bottom portion whereby rotational movement of the engaged cutter around the outer surface of the tubing facilitates cutting.

2. The tubing cutter of claim 1, wherein the rotational movement causes the chordal portion of the fixed blade to cut into the tubing a distance short of the total thickness of the tubing.

3. The tubing cutter of claim 1, wherein the body of the cutter is made of high density polyethylene.

4. The tubing cutter of claim 1, wherein the front piece and the back piece are removably secured together with fastening means.

5. The tubing cutter of claim 4, wherein the fastening means are screws.

6. A tubing cutter comprising a fixed blade and a C-shaped grasping portion having a tube receiving region for receiving plastic tubing, an opening, and a bottom portion positionally opposite the opening, the opening having a width generally less than the width of the tube receiving region and the tube receiving region having a width generally less than the diameter of the plastic tubing such that the C-shaped grasping portion is capable of snap engagement and circumferential grasping of the plastic tubing for rotational cutting of the tubing, wherein the grasping portion makes substantial surface contact around the circumference of the tubing a distance necessary to forcefully receive and deform the tubing within the tube receiving region, and a chordal portion of the fixed blade extends into and across the bottom portion of the grasping portion to facilitate cutting of the tubing during rotation.

7. The tubing cutter of claim 6, wherein the contact around the circumference of the tubing is a distance between 51 to 75 percent of the circumference of the tubing.

8. A C-shaped tubing cutter to snap onto and circumferentially grasp plastic tubing to facilitate the rotational cutting of the tubing, the cutter comprising:

a cutter body having a front piece removably securable to a back piece such that securement of the front piece and back piece form the body;

a C-shaped grasping portion formed in the body, the C-shaped grasping portion having a tube receiving region, an opening, and a bottom portion opposite the opening, the opening spanning a distance generally less than the width of the tube receiving region, such that the C-shaped grasping portion receives the plastic tubing with snap engagement and securely retains the plastic tubing during the cutting of the tubing;

a gripping portion formed in the body by at least one arcuate depression for human handling of the cutter; and a fixed blade secured between the front and back pieces of the body within a blade recessed portion such that a chordal portion of the blade extends into the grasping portion and across the bottom portion whereby rotational movement of the engaged cutter around the outer surface of the tubing facilitates cutting.

9. A tubing cutter for cutting tubing of a specified diameter, a specified wall thickness and having the cutter comprising:

a body comprising a pair of body pieces each having a face, the body pieces attachable to each other at the faces, at least one of the faces of the body pieces having a recess;

a fixed cutter blade sandwiched between the two body pieces in said recess and having a chordal portion;

the body having a fixed and integral C-shaped grasping portion configured for extending more than half way around the circumferential surface of the tubing of the specified diameter; and the C-shaped grasping portion defining a tubing receiving region, an opening, and a bottom blade portion distal and opposite the opening, the tube receiving region having a width generally greater than the opening, the chordal portion of the cutter blade positioned to extend across the bottom blade portion and into the tubing receiving region a distance less than the specified wall thickness of the tubing.

10. The tubing cutter of claim 9 further comprising cooperating protrusions and recesses for aligning the body pieces together.

11. The tubing cutter of claim 9 wherein the cutter blade is a single edged razor blade having a flange.

12. The tubing cutter of claim 9 wherein the C-shaped grasping portion has an inner facing circumferential surface with a diameter less than the diameter of the tubing.

13. A combination tubing cutter and dual containment tubing comprising an outer tubing of a specified diameter, a specified wall thickness, the tubing cutter for cutting tubing only, the cutter comprising:

a body comprising a pair of body pieces each having a face, the body pieces attachable to each other at the faces, at least one of the faces of the body pieces having a recess;

a fixed cutter blade sandwiched between the two body pieces in said recess and having a chordal portion;

the body having an integral C-shaped grasping portion configured for extending more than half way around the circumferential surface of the tubing of the specified diameter; and the C-shaped portion defining a tubing receiving region and an opening, the tube receiving region having a bottom portion directly opposite the opening and a width generally greater than the opening, the chordal portion of the cutter blade positioned to extend across the bottom portion and into the tubing receiving region a distance less than the specified wall thickness of the tubing.

* * * * *